United States Patent [19]

Taniguchi

[11] Patent Number: 4,484,731

[45] Date of Patent: Nov. 27, 1984

[54] METHOD AND APPARATUS FOR CONTINUOUSLY TREATING MOLTEN METAL

[76] Inventor: Hirotoshi Taniguchi, 81-173, Aza-Tendoshinden, Oaza-Maehara, Inuyama-shi, Aichi, Japan

[21] Appl. No.: 522,721

[22] Filed: Aug. 12, 1983

[30] Foreign Application Priority Data

Dec. 5, 1983 [JP] Japan ..... 58-82989

[51] Int. Cl.[3] ..... C22C 33/08

[52] U.S. Cl. ..... 266/216; 75/53; 75/130 R

[58] Field of Search ..... 75/130, 53; 266/216

[56] References Cited

U.S. PATENT DOCUMENTS

| | | | |
|---|---|---|---|
| 3,224,051 | 12/1965 | Brown | 75/53 |
| 3,258,328 | 6/1966 | Goss | 75/53 |
| 3,260,591 | 7/1966 | Brown | 75/53 |
| 3,331,680 | 7/1967 | Leupold | 75/53 |

FOREIGN PATENT DOCUMENTS

| | | | |
|---|---|---|---|
| 1245206 | 9/1971 | United Kingdom | 266/216 |
| 1271021 | 4/1972 | United Kingdom | 75/53 |
| 1270024 | 4/1972 | United Kingdom | 75/60 |
| 1543798 | 4/1979 | United Kingdom | 75/53 |
| 1579293 | 11/1980 | United Kingdom | 75/53 |

*Primary Examiner*—Peter D. Rosenberg
*Attorney, Agent, or Firm*—Browdy & Neimark

[57] ABSTRACT

Method and apparatus for continuously treating a mass of molten metal with a determinate treating agent, wherein the treating agent is continuously introduced in a treating vessel through a supply passage formed through the wall of the vessel while the molten metal is continuously poured into the vessel, for effecting a continuous contact of the molten metal with the introduced treating agent. The molten metal is discharged from a lower part of the vessel after it has been treated with the treating agent in the vessel. The treating vessel has a reaction chamber to which the supply passage is open. The treating vessel is adapted so that the poured molten metal which flows through the vessel temporarily stay in the reaction chamber for effective contact and reaction between the molten metal and the treating agent.

6 Claims, 6 Drawing Figures

METHOD AND APPARATUS FOR CONTINUOUSLY TREATING MOLTEN METAL

BACKGROUND OF THE INVENTION

The present invention relates generally to a method and an apparatus for continuously treating molten metal, and more particularly to such method and apparatus which are adapted to effect a continuous supply of determinate treating agents to a flowing mass of molten metal and thereby treat the molten metal through contact of the agents with the melt, in an effective manner irrespective of an amount of the melt to be treated.

There has been known in the art a method of improving the structure of cast products as in the form of an ingot, by adding a treating agent or agents (additives) to a molten metal from which the products are obtained by casting. For example, it is well known to inoculate a molten cast iron, or spheroidize the same for providing spheroidal or nodular graphite in the cast iron. To obtain such nodular graphite, various spheroidizing methods have been proposed. In a commonly employed spheroidizing method, predetermined spheroidizing agents such as Mg, RE, Ca, and other metals or their alloys are introduced into a ladle for reaction of a molten metal in the ladle with such treating metals or alloys, and the spheroidized melt is poured into a casting mold whereby a product is obtained in the form of nodular or spheroidal graphite cast iron.

However, such known spheroidizing method which requires a treating process within a ladle, makes it difficult to automate a process of pouring the molten metal into a mold through suitable automatic pouring equipment. Another potential problem associated with the known method resides in a loss of expensive treating agents such as Mg and RE because of their chronological change in properties during a time lapse in the range of several seconds to ten and several minutes, which time lapse is inevitable to transfer the spheroidized molten metal from the ladle to the casting mold. The requirement for the above transfer of the molten metal from the ladle to the mold causes environmental problems due to production of a large volume of white smoke and splashing of the melt, as well as makes the operation cumbersome and dangerous. Further, the contact of the molten metal with ambient air will possibly induce development of slags in a large amount, and consequently reduces efficiency of the spheroidizing agents and have an adverse effect on the quality of the end products.

In recent years, a so-called "in-mold treating process" has been attracting attention of the industry as one of spheroidizing methods. In such process, a required spheroidizing agent is accommodated in a reaction chamber formed in a casting mold, and a mass of molten cast iron is introduced into the reaction chamber for causing contact and reaction of the cast iron with the spheroidizing agent. The molten iron thus treated is then directed through a runner to a mold cavity formed in the other part of the casting mold. In this in-mold treating process, however, the molten metal once poured into the reaction chamber is introduced into the mold cavity only after the molten metal has overflowed the reaction chamber, and therefore the last volume of the molten metal is necessarily left within the reaction chamber. This will reduce the yield of the molten metal in the form of cast products, resulting in an increase in the casting cost of the products. In addition to this critical drawback, the process has further problems in connection with the casting mold which has a reaction chamber as stated above, that is, the mold must be large-sized and complicated in construction due to provision of such reaction chamber therein.

While the above indicated problems are all concerned with a spheroidizing process as applied to a molten cast iron, similar problems are inherent in other treatments of molten metal including an inoculation treatment thereof.

In summary, the prior methods for treating molten metal use a batch treatment process wherein the treatment is conducted in a vessel such as a ladle of a suitable type of a size depending upon the size of a product to be cast, or in a reaction chamber of a suitable size formed in a casting mold. It is found very much difficult to change the amount of treating agents in such treating vessel or chamber after the delivery of a molten metal is started. Thus, the treating agents may be insufficient in amount, or used in excess.

SUMMARY OF THE INVENTION

The present invention was made in view of the above described situation in the art. It is accordingly an primary object of the present invention to provide a method and an apparatus for effecting a continuous treatment of a molten metal.

Another object of the invention is to provide a method and an apparatus for continuously treating the molten metal by means of continuous contact thereof with constantly supplied treating agents while the molten metal is flowing.

A further object of the invention is the provision of such method and apparatus wherein the amount of the treating agents to be supplied to the molten meal for continuous contact therebetween can be adjusted as required.

A still further object of the invention is to provide such method and apparatus which permit continuous and effective treatment of the molten metal irrespective of the amount of the melt which is treated with the treating agents, and allow a considerable improvement in the yield of the molten metal as castings.

Other objects of the invention will become apparent from the following detailed description of the preferred embodiments and the accompanying drawings.

According to the present invention having the above indicated objects, there are provided a method and an apparatus for continuously treating molten metal with a determinate treating agent, wherein the treating agent is continuously introduced into a treating vessel through a supply passage formed through the wall of the vessel while the molten metal is continuously poured into the treating vessel, for effecting a continuous contact of the molten metal with the treating agent, and the molten metal thus treated with the treating agent within the vessel is subsequently discharged from a lower portion of the vessel.

In accordance with the present invention as outlined above, the molten metal poured into the treating vessel is held in continuous contact with the treating agent which is continuously delivered through the supply passage formed in the wall of the vessel, i.e., the continuously poured molten metal is put in contact with a fresh supply of the treating agent. Thus, an effective treatment of the melt is made possible. Further, the fact that the treating agent contacts directly the molten metal without contacting the ambient air, will lead to effective prevention of development of slags, white smokes and odor, and splashing of the melt as particularly experienced in a conventional spheroidizing treatment.

In addition, the quantity of the molten metal that is to be treated, is determined by an amount of the molten metal which is poured into a treating vessel, and/or a time interval during which the metal is poured into the vessel. As a result, the molten metal may be continuously treated in any desired quantity, either relatively small or large. In other words, a desired treatment of the molten metal can be effected upon pouring of the melt into a casting mold in a continuous manner without regard to the specific size of the mold or weight of the castings to be obtained from the molten metal.

According to another aspect of the invention, the amount of a treating agent may be controlled depending upon the rate at which the molten metal is poured into the vessel. In this respect, the present invention provides a novel method of continuous treatment which is distinquished from the known batch treatment wherein the molten metal is brought into contact with a treating agent which has been accommodated in a ladle or in a reaction chamber formed in a casting mold.

While the present invention is most suitably applicable to a graphite-spheroidizing treatment of a molten cast iron, the invention may find its application also in production of quasi-spheroidal graphite cast iron, in inoculating treatment of ductile cast iron, gray cast iron and cast steel by adding a suitable inoculant, and in deoxidizing, reducing and other treatments thereof.

In accordance with a preferred form of the invention, the determinate treating agent is gradually forced into the treating vessel while passing through a supply passage formed through the wall of the vessel such that the supply passage is kept filled with the treating agent. This arrangement effectively prevents the molten metal from leaking through the supply passage toward an agent supply device. The molten metal treated within the vessel through contact with the treating agent is discharged from the vessel and immediately led into a casting mold for casting thereof into an intended cast product.

For practicing the method of the present invention, there is provided also according to the invention an apparatus for continuously treating molten metal with a determinate treating agent, which comprises: (a) a treating vessel having at an upper portion thereof an inlet receiver into which the molten metal is poured, and at a lower portion thereof an outlet passage through which the molten metal is discharged from the vessel after treatment thereof, the treating vessel further having, at a portion thereof between the upper and lower portions, a reaction chamber which communicates with the inlet receiver and the outlet passage and wherein the molten metal is brought into contact with the treating agent; (b) a supply passage formed through the wall of the treating vessel and communicating with the reaction chamber for introducing the treating agent into the reaction chamber; and (c) supply means for feeding a predetermined amount of the treating agent into the reaction chamber through the supply passage.

In the continuously treating apparatus for molten metal constructed as described above, the supply means preferably comprises a screw for continuously advancing and feeding the treating agent.

According to a preferred form of the apparatus of the invention, the reaction chamber formed in the treating vessel is constructed such that an outlet of the reaction chamber is narrower than an inlet of the same so that the molten metal led from the inlet receiver is able to temporarily stay in the reaction chamber. This constructional arrangement permits uniform and consistent treatment of the molten metal with the treating agent. Further, it is preferable that the reaction chamber have a bent or curved profile such that the molten metal led from the inlet receiver is directed toward an opening of the supply passage at one end thereof, brought into contact with the treating agent adjacent to that open end of the supply passage, and then directed to the outlet passage.

In another preferred form of the apparatus according to the invention, the supply means comprises supply control means for adjusting an amount of the treating agent which is continuously fed into the reaction chamber.

To manifest the present invention, some exemplary embodiments of the invention will be described in detail with reference to the accompanying drawings. It is to be understood, however, that the invention be not limited by any of the details of description.

DETAILED DESCRIPTION OF THE PREFERRED EMBODIMENTS

Figure 1:
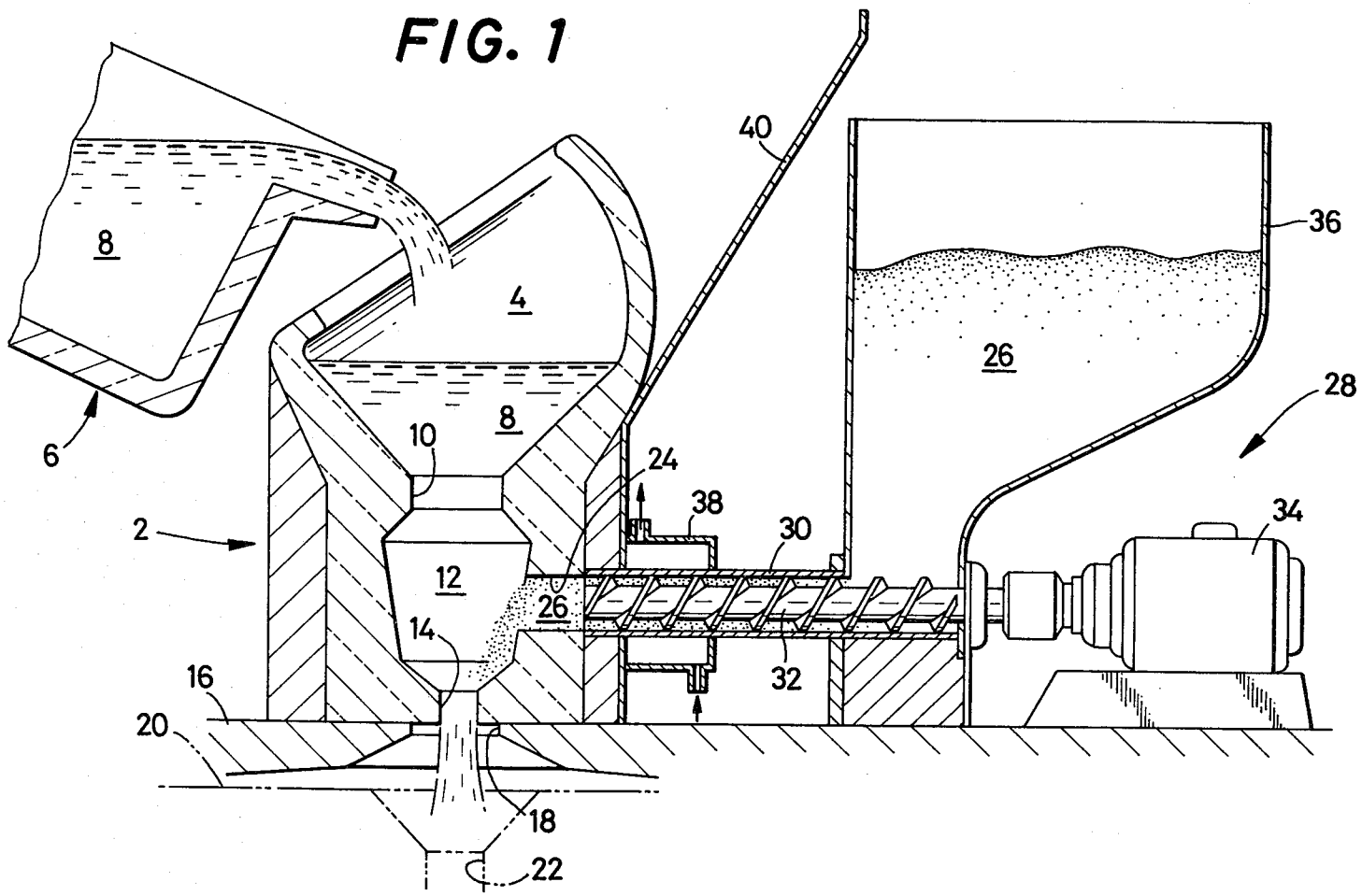
FIG. 1 is a schematic cross sectional elevation of one embodiment of an apparatus according to, and used in practicing, the present invention.

Referring first to FIG. 1 which illustrates in cross section one embodiment of an apparatus according to the invention, there is shown a treating vessel 2 fabricated of a refractory material. The treating vessel 2 has at its upper portion a bowl-shaped inlet receiver 4 having a large opening, into which a mass of molten metal 8 (molten cast iron or pig iron in this specific embodiment) is continuously poured from another vessel such as a ladle 6. The inlet receiver 4 is provided at its bottom portion with a passage 10 through which the inlet receiver 4 communicates with a reaction chamber 12 provided below the passage 10. The lower portion of the reaction chamber 12 leads to an outlet passage 14 which is open at the bottom surface of the treating vessel 2. The treating vessel 2 thus constructed rests on a base 16 which has a through-hole 18. The molten metal 8 which has been subjected to an intended treatment such as graphite-spheroidization, is directed through the through-hole 18 into a sprue 22 formed in a casting mold 20 which is disposed below the base 16.

A supply passage 24 is formed through the side wall of the treating vessel 2 in a direction substantially perpendicular to the direction of thickness of the side wall as shown in FIG. 1, such that the passage 24 is open in the reaction chamber 12. A determinate solid treating agent 26 in the form of particles or grains (spheroidizing agent in this specific embodiment) is introduced into the supply passage 24 by means of an agent supply device 28 which is installed on the base 16. The supply device 28 includes: a cylinder or cylindrical housing 30 connected to the supply passage 24; a screw 32 rotatably disposed within the cylinder 30; a variable-speed drive unit 34, as in the form of a motor, coupled with the rear end of the screw 32 to rotate the same about its axis; and a hopper 36 for delivering the determinate treating agent into the cylinder 30. A portion of the cylinder 30 adjacent to its connection with the supply passage 24 is surrounded by a cooling enclosure 38 in which a suitable cooling fluid such as water or air is circulated for cooling the treating agent 26 within the cylinder 30 so as to protect the agent 26 from heat of the molten metal 8 in the vessel 2 and thereby avoid adverse effects of such heat on the agent, e.g., dissolution and consequent reaction of the agent 26 under heat.

Numeral 40 designates a splash guard for protecting the agent supply device 28 against scattering drops of the molten metal 8 upon pouring thereof into the inlet receiver 4.

In the apparatus of the above described arrangement, the molten metal 8 is poured from the ladle 6 into the inlet receiver 4 in the treating vessel 2, and led into the reaction chamber 12, while the treating agent 26 stored in the hopper 36 is supplied to the cylinder 30, and delivered to the supply passage 24 by means of a forwardly conveying action of the revolving screw 32 rotated by the drive unit 34. The treating agent 26 delivered to the passage 24 is continuously forced or pushed into the reaction chamber 12 while the passage 24 is filled or plugged with the agent 26 thereby preventing the molten metal 8 from passing through the passage 24 toward the screw 32. Thus, the molten metal 8 within the reaction chamber 12 is brought into continuous contact with the treating agent 26, with a result of inducing a required reaction between the metal 8 and the agent 26, and thus the treated molten metal 8 is obtained. Stated in the other way, the molten metal 8 which is continuously fed from the inlet receiver 4 down to the reaction chamber 12 is mixed with the introduced treating agent 26 while the metal 8 flows or passes through the reaction chamber 12, and the mixing causes an intended reaction between the metal and the agent required for treatment of the metal. The molten metal 8 treated through contact with the treating agent 26 is discharged through the outlet passage 14 located below the reaction chamber 8, and immediately introduced into the sprue 22 of the casting mold 20 disposed below the treating vessel.

Thus, the above disclosed apparatus of the invention allows a continuous supply of the treating agent 26 through the supply passage 24 to the molten metal 8 while it is continuously poured into the treating vessel 2. The contact of the molten metal 8 with the treating agent 26 causes the required reaction therebetween which permits the intended treatment of the metal in a continuous fashion. It is noted that the amount of the molten metal 8 to be treated is determined soley by the amount thereof which is introduced from the ladle into the vessel 2, whereby the molten metal can be treated in any quantity as required to meet the shape, size, weight and other parameters of the final casting product. It is also noted that the treating agent 26 which is continuously forwarded by the screw 32 fills the supply passage 24 before it is introduced into the reaction chamber 12 for contact with the molten metal 8 flowing down through the reaction chamber 12. Thus, the treating agent 26 substantially eliminates chances of contact of the molten metal 8 with atmosphere and thereby extremely reduces or minimizes otherwise possible development of slags (MgO, CaO, etc.) and resultant loss of a spheroidizing agent, e.g., Mg, as conventionally encoutered during a spheroidizing treatment, as well as prevents production of voluminous white smokes, odors, and splashing of the molten metal as experienced during a spheroidizing reaction, whereby the conventional potential of operational hazards is substantially eliminated and the operating environment and safety are improved to an appreciable extent.

The molten metal 8 which has been introduced into the reaction chamber 12, is brought into contact with a fresh supply or amount of the treating agent 26 which is continuously delivered through the supply passage 24. This continuous supply of the agent assures effective reaction between the flowing molten metal and the fresh supply of the agent. Further, the drive unit 34 of the agent supply device is variable in operating speed, and consequently the rotating speed of the screw 32 is adjustable by controlling the variable-speed drive unit, whereby the rate of feeding of the treating agent 26 to the supply passage 24, i.e., the amount of supply per unit time to the reaction chamber 12 can be adjusted, that is, increased or decreased, as needed. Therefore, the magnitude of reaction between the molten metal 8 and the treating agent 26, namely, the degree of treatment of the molten metal 8, can be controlled as required. This means that a mass of molten metal 8 can be continuously processed with different magnitudes of treatment for different portions thereof. The thus differently treated individual portions of the molten metal 8 are continuously discharged through the outlet passage 14 into the casting mold, thereby making it possible to form a casting having portions which are different in structure due to difference in the degree of treatment between corresponding portions of the molten metal. In this respect, it is noted that the methods known in the art have suffered extreme difficulty in changing the supply amount of the treating agent 26 or the magnitude of reaction of the molten metal with the treating agent while the molten metal is being poured, and thus the prior method was rarely expected to permit production of a casting whose individual portions have different structures.

In the above described preferred embodiment, the treated molten metal 8 is directed into the sprue 22 and then into the mold cavity of the casting mold 20 immediately after the metal 8 has been discharged out of the vessel 2 through the outlet passage 14, thereby substantially preventing a loss of spheroidizing agent (26) such as Mg, RE and other alloy additives, which loss may be otherwise caused due to chronological change in properties thereof. The prevention of such loss will permit production of nodular or spheroidal graphite cast iron of consistently high quality, as well as contribute to reducing the required amount of consumption of the expensive spheroidizing agents such as Mg and RE and consequently improving the yield of the molten metal treated with such agents, as compared with the prior method.

In the above embodiment of the apparatus, the reaction chamber 12 has an outlet (outlet passage 14) which is narrower than an inlet (passage 10) thereof, so that the molten metal 8 led from the inlet receiver 4 may temporarily stay or dwell within the reaction chamber 12 so as to enable the molten metal 8 to effectively contact the treating agent delivered through the supply passage 24 and to even or uniform the treatment of the molten steel.

Further, the treating vessel 2 is so constructed that the entire amount of the molten metal 8 within the reaction chamber 12 is discharged, i.e., no portion of the melt is left as a loss within the chamber 12. This arrangement will remarkably improve the yield of the treated molten metal.

Figure 2:
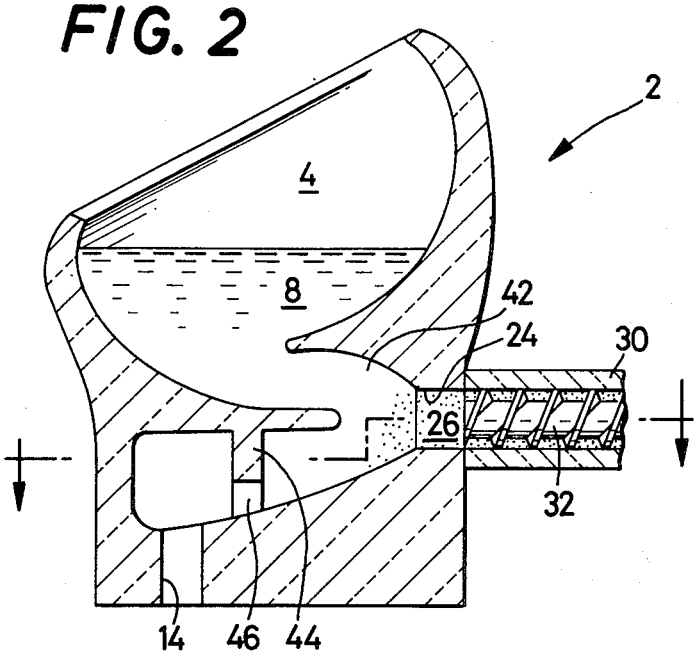
FIG. 2 is a schematic cross sectional elevation of a treating vessel provided in a form different from that used in the apparatus of FIG. 1.
Figure 3:
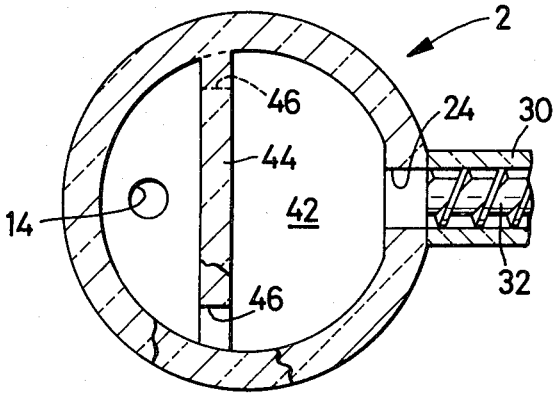
FIG. 3 is a cross sectional view taken along line III—III of FIG. 2.

There is shown in FIGS. 2 and 3 another embodiment of the apparatus of the invention which is characterized by its reaction chamber 12 different in construction from that of the previous embodiment.

In the figures, the reaction chamber 42 has a bent or curved profile so that the molten metal 8 received by the inlet receiver 4 of the vessel 2 can be directed from the chamber 4 toward the open end or opening of the supply passage 24 so as to meet the treating agent 26 which is forced out from the passage 24, thus allowing the flowing molten metal 8 to more effectively contact the agent 26 such as a shperoidizer. The molten metal 8 thus contacted with the agent 26 temporarily stays within the reaction chamber 42 such that it is dammed or obstructed by a partition 44 which is provided in a passage connecting the reaction chamber 42 and the outlet passage 14 formed in the bottom portion of the vessel 2. The molten metal 8 which has temporarily stayed within the reaction chamber 42, flows through holes 46 formed through opposite lateral end portions of the partition 44, into the outlet passage 14 and reaches a casting mold or other object. In FIGS. 2 and 3, the same reference numerals are used to identify parts which are similar in function to the corresponding parts of FIG. 1.

As described above, the profile of the reaction chamber 42 of this embodiment is bent or curved in order that a flow of molten metal 8 from the inlet receiver 4 is positively put into contact with the treating agent 26 pushed out of the supply passage 24, i.e., an effective contact is obtained between the metal 8 and the agent 26. This provision for such positive and effective contact will lead to enhancement in uniformity or evenness of the spheroidizing treatment involved. The treatment uniformity is further improved by the provision of the partition 44 which serves to provide a temporary stay or dwelling of the molten metal within the reaction chamber 42.

Figure 4:
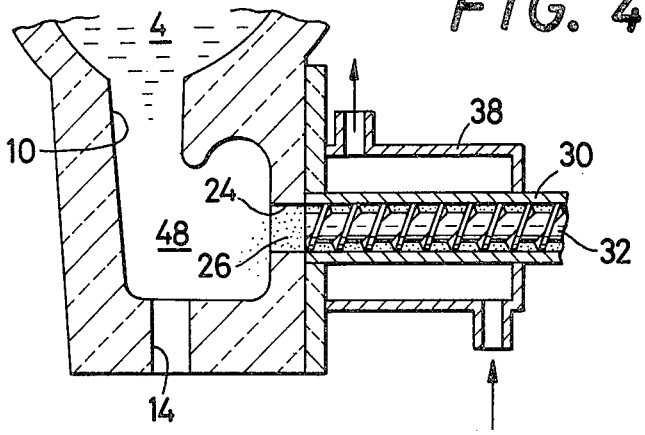
FIGS. 4 and 5 are fragmentary cross sectional views showing reaction chambers of different shapes provided in other forms of the treating vessel.
Figure 5:
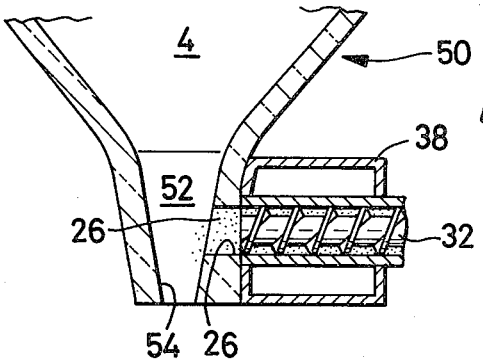

Other forms of the treating vessel 2 having various constructions as illustrated in FIGS. 4 and 5, may be employed for the purpose of the invention so long as the treating agent 26 continuously delivered through the supply passage 24 is brought into continuous contact with the continuously flowing molten metal 8 within the vessel. The same reference numerals are used in FIGS. 4 and 5 to identify the parts similar to those in the previous embodiments, and the detailed description thereof is omitted herein.

The treating vessel 2 shown in FIG. 4 has the outlet passage 14 which is smaller in diameter than that of the passage 10, and is provided with a reaction chamber 48 which is formed as a large cavity capable of temporarily accommodating a relatively large volume of the molten metal 8, whereby the molten metal 8 in the large-volume reaction chamber is kept in contact with the continuously delivered treating agent 26 for a relatively long period of time and thereby treated evenly throughout the whole mass before it is fed through the outlet passage 14 into the casting mold 20 located below the vessel.

The treating vessel 50 shown in FIG. 5 is generally funnel-shaped, having at its upper portion the inlet receiver 4 which is wide-mouthed for facilitating pouring of the molten metal 8 as from the ladle 6. The treating vessel 50 has at its leg portion a reaction chamber 52 which leads to an outlet 54 open at the bottom of the vessel 50. The reaction chamber 52 is tapered in cross section with its diameter progressively diminishing toward the outlet 54. The treating agent 26 advanced by the screw 32 is introduced into the tapered reaction chamber 52 through the supply passage 24 formed through the wall of the chamber 52, and put into contact with the downwardly flowing molten metal 8. It is also noted in this arrangement that the molten metal 8 which has been poured in the inlet receiver 4 and subjected to a required treatment through contact with the treating agent 26 within the reaction chamber 52, is entirely discharged through the outlet 54 with no portion thereof being left as a residue within the vessel 50, resulting in an improved yield of the molten metal.

Figure 6:
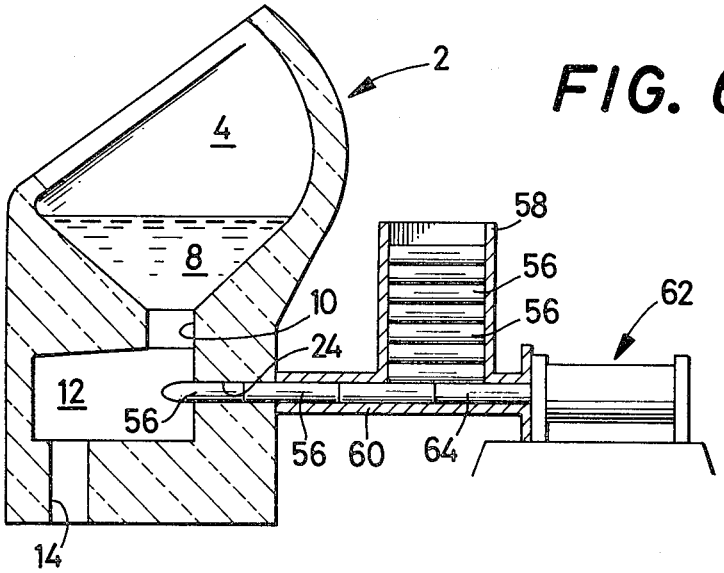
FIG. 6 is a schematic cross sectional elevation of another embodiment of the apparatus according to the invention.

Referring to FIG. 6, there is another embodiment of the apparatus of the invention which is constructed to permit the use of a solid treating agent 56 in the form of a bar which is fed into the reaction chamber 12 of the vessel 2. This alternative embodiment also uses the same reference numerals as in the first embodiment to identify the similar parts.

The bar-shaped treating agents 56 used in the apparatus of FIG. 6 are piled horizontally one on another within a storage 58. The storage 58 is connected at its bottom to a supply tube 60 so that the treatment bars 56 are dropped into the tube 60 one after another. The treatment bar 56 dropped in the tube 60 is forwardly pushed on its rear end by a push rod 64 actuated by a pusher 62 including a cylinder, and thus the treatment bar 56 is inserted into the supply passage 24 connected to the supply tube 60, i.e., penetrates the wall of the treating vessel 2 and protrudes into the reaction chamber 12 for continuously contacting the molten metal 8 flowing from the inlet receiver 4.

The use of the treating agent 56 in the form of a push-out bar whose diameter may be made substantially equal to that of the supply passage 24, will assure continuous and effective delivery of the agent from the outside of the vessel 2 into the reaction chamber 12 within the vessel 2 with virtually no possibility of leakage of the molten metal 8 through the supply passage 24. This method of supplying the agent provides an additional advantage that the supply device may be simplified in construction.

While the present invention has been described as related to several preferred embodiments, it is to be understood that the invention is not limited to those specific embodiments but may be otherwise embodied with various changes and modifications that may occur to those skilled in the art without departing from the spirit of the invention; it will be obvious that the invention may comprises those other embodiments than specifically described herein. For example, unlike the foregoing embodiments wherein the molten metal which has been treated within the reaction chamber through continuous contact with a continuously delivered molten metal is immediately poured into a casting mold, it is possible to receive the treated molten metal in a ladle or other vessel before it is poured into the mold. Further, the application of the present invention which has been described above in association with a spheroidizing treatment of molten cast iron (pig iron), may include: inoculating treatment with inoculants such as Ca, Al, Ca-Si and Fe-Si; oxidation; reduction; etc., of ductile cast iron, gray cast iron and cast steel.

What is claimed is:

1. An apparatus for continuous treating molten metal with a solid treating agent, which comprises:

a treating vessel having at an upper portion thereof an inlet receiver into which the molten metal is poured, and at a lower portion thereof an outlet passage through which the molten metal is discharged out of said treating vessel after the metal is treated, said treating vessel further having, at a portion thereof between said upper and lower portions, a reaction chamber which communicates with said inlet receiver and said outlet passage and in which the molten metal is brought into contact with the treating agent, said reaction chamber having an inlet leading to said inlet receiver, and an outlet open at one end of said outlet passage, said outlet being narrower than said inlet;

a supply passage formed through the side wall of said treating vessel substantially perpendicularly to the direction of thickness of said side wall, and communicating direction of thickness of said side wall, and communicating with said reaction chamber; and supply means for feeding a predetermined amount of the treating agent into said reaction chamber through said supply passage.

2. An apparatus as recited in claim 1, wherein an outlet of said reaction chamber is narrower than an inlet of the same whereby the molten metal led from said inlet receiver temporarily stays in said reaction chamber.

3. An apparatus as recited in claim 1, wherein said reaction chamber has a bent or curved profile such that the molten metal led from said inlet receiver is directed toward one end of said supply passage open in said reaction chamber, put into contact with the treating agent adjacent to said one end of the suppy passage, and then directed to said outlet passage of the vessel.

4. An apparatus as recited in claim 1, wherein said supply means comprises supply control means for adjusting an amount of the treating agent which is continuously fed into said reaction chamber.

5. An apparatus as recited in claim 1, wherein said treating agent is provided in the form of particles.

6. An apparatus as recited in claim 1, wherein said treating agent is provided in the form of a bar and said supply means comprises a tube connected to said supply passage, a storage connected at its bottom to said tube and storing said bar in plurality, and a pusher for pushing said bar in said tube toward said reaction chamber.

* * * * *